US006902710B2

(12) United States Patent
Schnigenberg

(10) Patent No.: US 6,902,710 B2
(45) Date of Patent: Jun. 7, 2005

(54) METHOD FOR THE PRODUCTION OF A CATALYTIC CONVERTER HOUSING USING A WINDING-TENSIONING TECHNIQUE

(75) Inventor: Jörn Schnigenberg, Schauenburg (DE)

(73) Assignee: Volkswagen AG, Wolfsburg (DE)

( * ) Notice: Subject to any disclaimer, the term of this patent is extended or adjusted under 35 U.S.C. 154(b) by 866 days.

(21) Appl. No.: 09/805,719

(22) Filed: Feb. 27, 2001

(65) Prior Publication Data

US 2001/0055551 A1 Dec. 27, 2001

Related U.S. Application Data

(63) Continuation of application No. PCT/EP99/05320, filed on Jul. 26, 1999.

(30) Foreign Application Priority Data

Aug. 26, 1998 (DE) ..... 198 38 750

(51) Int. Cl.[7] ..... B01D 50/00; B01D 53/34
(52) U.S. Cl. ..... 422/179; 422/180
(58) Field of Search ..... 422/179, 180, 422/177, 168

(56) References Cited

U.S. PATENT DOCUMENTS 5,882,608 A * 3/1999 Sanocki et al. ..... 422/179
5,945,361 A 8/1999 Hashimoto et al. ..... 501/95.1
6,405,437 B1 * 6/2002 Sussmilch et al. ..... 29/890.08

FOREIGN PATENT DOCUMENTS

EP 0818615 1/1998
WO 9119081 12/1991

OTHER PUBLICATIONS

EP 0837229 Abstract.

* cited by examiner

*Primary Examiner*—M. Alexandra Elve
(74) *Attorney, Agent, or Firm*—Baker Botts L.L.P.

(57) ABSTRACT

A catalytic converter is manufactured by wrapping a monolith core in an intumescent mat, surrounding the core and mat with a pre-wound metal jacket and compressing the jacket using tension bands. During compression the housing jacket is knocked at a frequency between 20 and 80 Hz to cause setting of the intumescent mat between the core and the jacket.

13 Claims, 1 Drawing Sheet

METHOD FOR THE PRODUCTION OF A CATALYTIC CONVERTER HOUSING USING A WINDING-TENSIONING TECHNIQUE

This application is a continuation of International Application PCT/EP99/05320 filed Jul. 26, 1999, which International application was published on Mar. 9, 2000, by the International Bureau in German.

BACKGROUND OF INVENTION

The invention relates to a method for producing a catalytic converter.

In connection with the manufacture of catalytic converters with ceramic monolith substrates, it is necessary to protect the monolith in the catalytic converter housing from mechanical stress. This is generally accomplished using an expanded or intumescent mat, which cushions the monolith from the metallic catalytic converter housing.

Catalytic converter housings such as those used to secure a catalyst in the exhaust systems of internal combustion engines, more particularly those of motor vehicles, exist in a variety of embodiments, wherein two systems have prevailed in the market. In the first system, a monolith (usually made of ceramic), coated with a catalytically active material, is wrapped in an intumescent mat that supports the monolith. Together with the monolith, this intumescent mat is then placed in a pre-rolled sheet-metal jacket which holds the monolith and the intumescent mat in position. The pretensioned sheet-metal jacket is subsequently tacked at individual points by means of spot welding. Inlet and outlet cones for connection to an exhaust pipe are affixed to the end faces of the jacket. The cones are attached by a continuous circumferential weld seam on the wound converter. The sheet-metal jacket is then closed by a weld seam yielding the finished catalytic converter.

The manufacture of a catalytic converter housing by means of a winding and tensioning technique of this type, such as is described in EP 0 818 615 A2, for example, has basically proven itself, but is capable of improvement with regard to secure retention of the monolith inside the housing jacket by means of the intumescent mat.

A second system in the market is known as a clamshell converter, and consists of a monolith, a separate intumescent mat and two shell halves, specifically a top shell half and a bottom shell half. However, process reliability is often inadequate in the case of clamshell converters. Moreover, the geometry determined by the shell shape frequently causes difficulties in adapting to motor vehicle underbodies.

The object of the invention is to provide a method for manufacturing a catalytic converter with a housing using the winding and tensioning technique, wherein the catalytic converter core, particularly a monolith, can be retained in an especially secure and permanent manner within the housing jacket, thereby ensuring long-term stability of the catalytic converter over its lifetime.

SUMMARY OF THE INVENTION

In accordance with the invention, while the housing jacket is compressed around the catalytic converter core and intumescent mat, the jacket is knocked at a predetermined frequency, causing setting of the intumescent mat.

As a result of this knocking, which in accordance with an advantageous embodiment is carried out at a knocking frequency of 20 to 80 Hz, preferably 40 to 50 Hz, for a duration of, for example, 5 seconds, the setting of the intumescent mat takes place in a significantly more effective manner during tensioning of the housing jacket by the tension bands, ensuring a secure seating of the monolith within the housing jacket over the entire lifetime of the catalytic converter.

In accordance with an advantageous embodiment of the invention, the intumescent mat is inserted in the housing jacket so that the intumescent mat overlap is offset by 180° from the overlap of the housing jacket. Doing so reliably prevents superposition of the two overlaps, which could impair tightening of the intumescent mat and/or the housing jacket.

According to especially advantageous embodiment, the tensioning force for pretensioning the housing jacket is increased toward the end of the knocking process to a value of 10 to 30 kN, particularly about 20 kN. This force-controlled tensioning of the housing jacket with simultaneous knocking brings about setting and firm wrapping of the intumescent mat in an especially effective manner.

According to with an advantageous embodiment, the housing jacket is tacked by means of spot welding after the pretensioning. Cones are welded onto the end faces of the tack-welded housing jacket by means of circumferential seams. The overlap of the housing jacket is not filly welded shut with a longitudinal seam until after the cones have been welded on. In this way, the catalytic converter housing can be manufactured in a very fast, dimensionally accurate and cost-effective manner.

The invention is described in detail below by means of examples using the drawings.

DETAILED DESCRIPTION OF PREFERRED EMBODIMENTS

Figure 1:
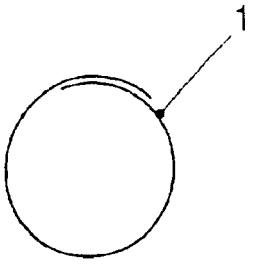
FIG. 1 is an end view of a pre-rolled housing jacket.
Figure 2:
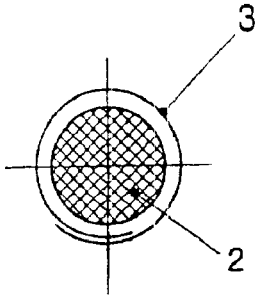
FIG. 2 is an end view of a monolith wrapped in an intumescent mat

FIG. 1 shows an end view of a housing jacket 1 of sheet metal that has been cylindrically rolled or wound from a plate such that the ends overlap. Shown in FIG. 2 is a monolith core 2 in the form of a cylindrical ceramic substrate wrapped with an intumescent mat 3. The ends of the wrapped intumescent mat 3 overlap.

Figure 3:
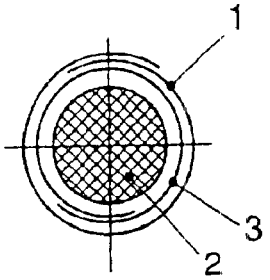
FIG. 3 is an end view of a monolith and intumescent mat surrounded by a housing jacket.

As shown in FIG. 3, the monolith 2 wrapped in the intumescent mat 3, is subsequently placed in the wound housing jacket 1, such that the housing jacket surrounds the monolith core. This placement is accomplished in such a manner that the position of the intumescent mat overlap is offset by 180° from the overlap of the housing jacket 1.

Next, in a special fixture, the housing jacket 1, and thus also the intumescent mat 3 inside it, are compressed using tension bands 4, during which process the setting of the intumescent mat 3 is ensured by knocking the housing jacket 1 at a frequency of, for example, 45 Hz for a selected period, for example, more than 2 seconds, preferably about 4 to 5 seconds. At the same time, the compression force on the tension bands is increased to a value of 10–30 kN, for example, 20 kN toward the end of the knocking process in order to guarantee secure seating of the monolith 2.

Figure 4:
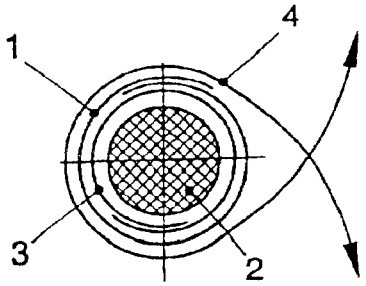
FIG. 4 is a representation of the tensioning process by which the housing jacket is pretensioned.
Figure 5:
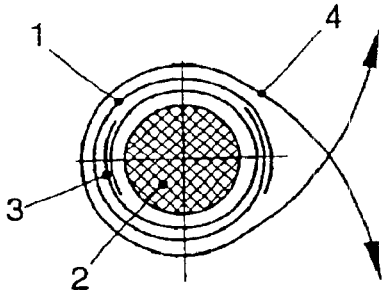
FIG. 5 is a representation of an alternative tensioning process for the housing jacket.

In the example embodiment illustrated in FIG. 4, the overlaps of the housing jacket 1 and the intumescent mat 3 are each offset by 90° from the center plane of tensioning, which in FIG. 4 is the horizontal plane that passes through the central plane of the monolith 2 and through the intersection point of the tensioning bands 4. However, another possible alternative is to arrange the housing jacket 1 within the tensioning bands 4 such that the overlaps of the housing jacket 1 and the intumescent mat 3 lie in this horizontal center plane of tensioning, as shown in FIG. 5.

Figure 6:
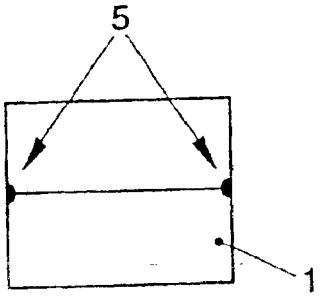
FIG. 6 is a side view of a spot-welded housing jacket after the tensioning process.

The housing jacket 1 tensioned in this way is subsequently tacked by spot welds 5 near the end faces of housing jacket 1, as shown in FIG. 6.

Figure 7:
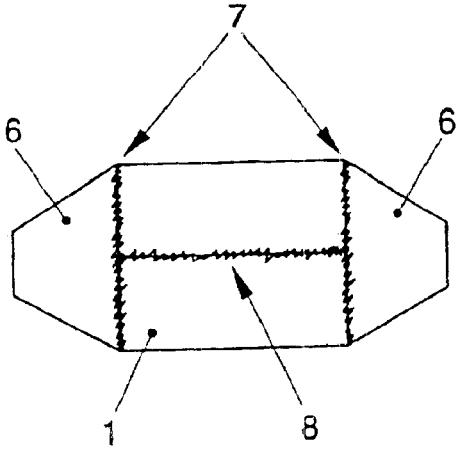
FIG. 7 is a side view of the finished catalytic converter housing after attachment of the cones to the end faces.

The catalytic converter housing prepared in this way is subsequently placed in a welding jig and wherein cones 6 are attached to the end faces as shown in FIG. 7. The cones 6 are welded onto the housing jacket 1 by means of circumferential weld seams 7, which can be accomplished for example by MAG welding. Thereafter, the tack-welded overlap seam of the housing jacket 1 is fully closed by a longitudinal weld seam 8, completing the catalytic converter.

While here have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

What is claimed is:

1. A method for making a catalytic converter comprising:

wrapping a catalytic converter core in an intumescent mat;

surrounding said catalytic converter core and said intumescent mat with a pre-wound metal jacket;

compressing said pre wound jacket around said catalytic converter core and intumescent mat with tension bands; and knocking said pre-wound jacket at a frequency of 20 to 80 Hz during said compression to cause setting of said intumescent mat between said core and said jacket.

2. A method as specified in claim 1, wherein said knocking is at a frequency of 40 to 50 Hz.

3. A method as specified in claim 1, wherein said knocking takes place for a period exceeding 2 seconds.

4. A method as specified in claim 3, wherein said knocking takes place for a period of about 4 to 5 seconds.

5. A method as specified in claim 1, wherein said intumescent mat has an overlap and wherein said pre-wound metal jacket has an overlap, and wherein in said surrounding said overlap of said jacket is offset from said overlap of said mat by approximately 180°.

6. A method as specified in claim 1, wherein said compression by said tension bands is increased during said knocking.

7. A method as specified in claim 6, wherein said tension is increased to a value of 10 to 30 kN.

8. A method as specified in claim 7, wherein said tension is increased to 20 kN.

9. A method as specified in claim 1, wherein said housing jacket is tacked by spot welding after said compressing.

10. A method as specified in claim 9, wherein cores are welded to the ends of said tack welded housing by circumferential seams, and wherein said housing jacket is welded with a longitudinal seam following welding of said cones.

11. A catalytic converter made by the method of claim 1.

12. A catalytic converter made by the method of claim 5.

13. A catalytic converter made by the method of claim 10.

* * * * *